United States Patent [19]

Shimada et al.

[11] 4,328,400

[45] May 4, 1982

[54] COAXIAL MULTI-WAY PLANAR DIAPHRAGM TYPE LOUDSPEAKER SYSTEM

[75] Inventors: Kunihiko Shimada; Yukio Tsuchiya, both of Tokorozawa, Japan

[73] Assignee: Pioneer Electronic Corporation, Tokyo, Japan

[21] Appl. No.: 164,117

[22] Filed: Jun. 30, 1980

[30] Foreign Application Priority Data

| | | | |
|---|---|---|---|
| Jun. 30, 1979 | [JP] | Japan | 54/90263[U] |
| Jun. 30, 1979 | [JP] | Japan | 54/90264[U] |
| Jun. 30, 1979 | [JP] | Japan | 54/90268[U] |
| Jun. 30, 1979 | [JP] | Japan | 54/90276[U] |

[51] Int. Cl.³ ..... H04R 9/06

[52] U.S. Cl. ..... 179/116

[58] Field of Search ..... 179/101, 110 A, 111 R, 179/114 R, 114 A, 115 R, 115 A, 115.5 R, 116, 181 R, 181 F; 181/163-165

[56] References Cited

U.S. PATENT DOCUMENTS

| | | | |
|---|---|---|---|
| 2,297,218 | 9/1942 | Henrich et al. | 179/181 F |
| 3,008,013 | 11/1961 | Williamson et al. | 179/111 R |
| 3,268,672 | 8/1966 | Roesel, Jr. et al. | 179/115.5 R |
| 3,943,304 | 3/1976 | Piribauer | 179/115.5 PS |
| 4,005,278 | 1/1977 | Gorike | 179/181 R |
| 4,152,552 | 5/1979 | Meyer | 179/115.5 H |
| 4,191,863 | 3/1980 | Matsuda et al. | 179/115.5 R |
| 4,198,550 | 4/1980 | Matsuda et al. | 179/181 F |

FOREIGN PATENT DOCUMENTS

| | | | |
|---|---|---|---|
| 104293 | 10/1926 | Austria | 179/111 R |
| 1256674 | 2/1961 | France | 179/115.5 R |

*Primary Examiner*—George G. Stellar

*Attorney, Agent, or Firm*—Sughrue, Mion, Zinn, Macpeak & Seas

[57] ABSTRACT

A coaxial multi-way planar diaphragm loudspeaker system having inner and outer frames rigidly coupled to each other. An inner peripheral edge portion of a planar diaphragm for the bass-range and an outer peripheral edge portion of a planar diaphragm for the mid-range are commonly supported by a common edge supporting member which is rigidly coupled to the front surface of the inner frame. A single backchamber is provided for the mid-range and higher-range speaker units to separate them from the rear chamber of the bass-range loudspeaker unit. The backchamber has an inclined surface portion extending toward the the rear-side of the bass-range loudspeaker unit. The driver units for the treble-ranges are attached to the frame through a mounting bracket having an oblong screw hole so that they can first be assembled then accurately positioned.

8 Claims, 4 Drawing Figures

COAXIAL MULTI-WAY PLANAR DIAPHRAGM TYPE LOUDSPEAKER SYSTEM

BACKGROUND OF THE INVENTION

The present invention relates to planar diaphragm type loudspeaker systems. More particularly, the invention relates to a loudspeaker system in which square planar diaphragms for bass-range, mid-range and treble-range are arranged coaxially.

It is known that a planar diaphragm has acoustic pressure characteristics relatively flat over a wide frequency range thus providing high fidelity sound reproduction. A variety of such type loudspeaker systems using planar diaphragms have been proposed in the prior art. In a conventional planar diaphragm type loudspeaker system, loudspeaker units adapted to reproduce bass, mid and treble ranges, respectively, have been separately mounted on a baffle board. One of the significant features of such a planar diaphragm type loudspeaker system resides in that the acoustic image scarcely shifts. In a multi-way, that is, a 2-way, 3-way and 4-way loudspeaker system, however, the above feature becomes more remarkable by arranging the diaphragms coaxially.

For this purpose, to assemble such a coaxial multi-way planar diaphragm type loudspeaker system, there is a problem in that it is difficult to arrange and assemble planar diaphragms of loudspeaker units covering all frequency ranges coaxially with the same ease as a loudspeaker system using cone-shaped diaphragms. That is, since the backside spaces of respective planar diaphragms are common, disadvantages that the backside pressure may cause interference and that the construction of a frame assembly supporting the planar diaphragms is complicated occur. Furthermore, in the case where planar diaphragm type loudspeaker units covering bass, mid, treble and further super-treble ranges are arranged coaxially, a difficulty in a backchamber provided for the mid-range diaphragm may occur. Since the planar diaphragm for the bass-range is arranged at an outermost side, a large opening aperture is required. Moreover, in the case where a backchamber for a mid-range loudspeaker unit having a large inner capacity is provided in the rear-side space of the bass-range planar loudspeaker unit whereby the rear-side space of the mid-range planar loudspeaker unit is separated from that of the bass unit, the bass-range planar diaphragm is subjected to a backside pressure caused by the backchamber when it is reciprocated. Therefore, the reciprocating movement thereof may be adversely interfered with.

SUMMARY OF THE INVENTION

Accordingly, an object of the invention is to eliminate the above described drawbacks accompanying conventional planar diaphragm type loudspeaker systems.

Another object of the invention is to provide a coaxial multi-way planar diaphragm type loudspeaker system capable of preventing interference among plural planar diaphragms in a rear-side space thereof and to provide a speaker system of simple construction.

The above objects, as well as other objects of the invention are met by the provision of a coaxial multi-way planar diaphragm type loudspeaker system having the following construction. In the speaker system according to the invention, at least an inner peripheral edge portion of a planar diaphragm for a bass-range and an outer peripheral edge portion of a planar diaphragm for a mid-range are supported by a common edge supporting member provided on a front surface of an inner frame. The backsides of the mid-range and higher-range speaker units positioned at a central position respective to the bass-range loudspeaker unit are accomodated in a single backchamber so that the rear space of the bass-range loudspeaker unit is separated from those of the others. In the backchamber, rear spaces of the mid, treble and super-treble-range loudspeaker units are also separated from each other. Furthermore, the backchamber is shaped to have an inclined surface at a position extending toward the rear-side space of the bass-range loudspeaker unit so that a large rear-side space of the bass-range speaker unit is obtained and the cross-sectional area of the backchamber facing the bass-range loudspeaker unit is reduced. In addition, the rear-side spaces of at least bass and mid-range loudspeaker units are completely separated by a square-shaped diaphragm supporting frame and the backchamber.

DESCRIPTION OF THE PREFERRED EMBODIMENTS

The present invention will be described in detail with reference to the accompanying drawings.

Figure 1:
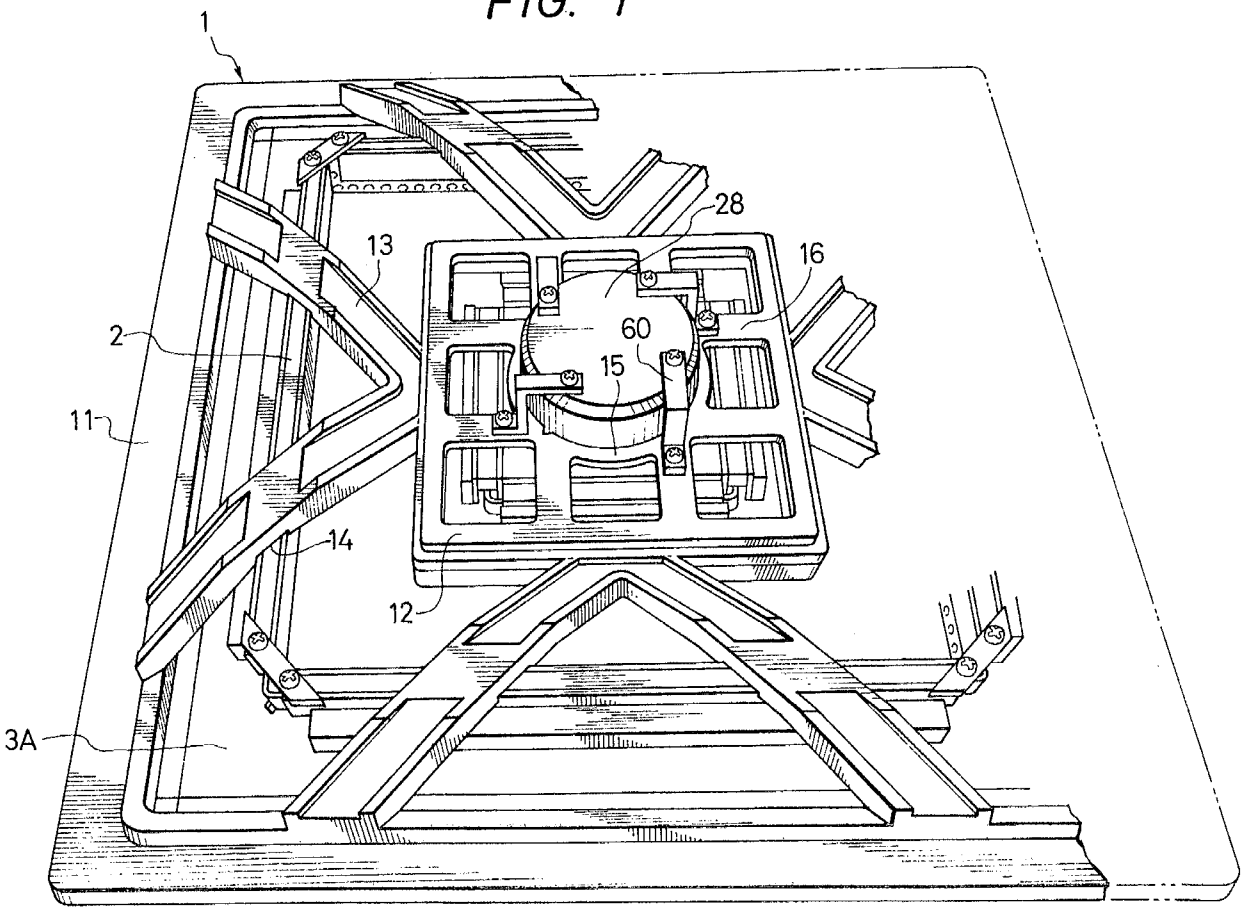
FIG. 1 is a schematic perspective view illustrating the back side of a coaxial multi-way planar diaphragm type loudspeaker system constructed according to the present invention with a back chamber removed for purposes of illustration.
Figure 2:
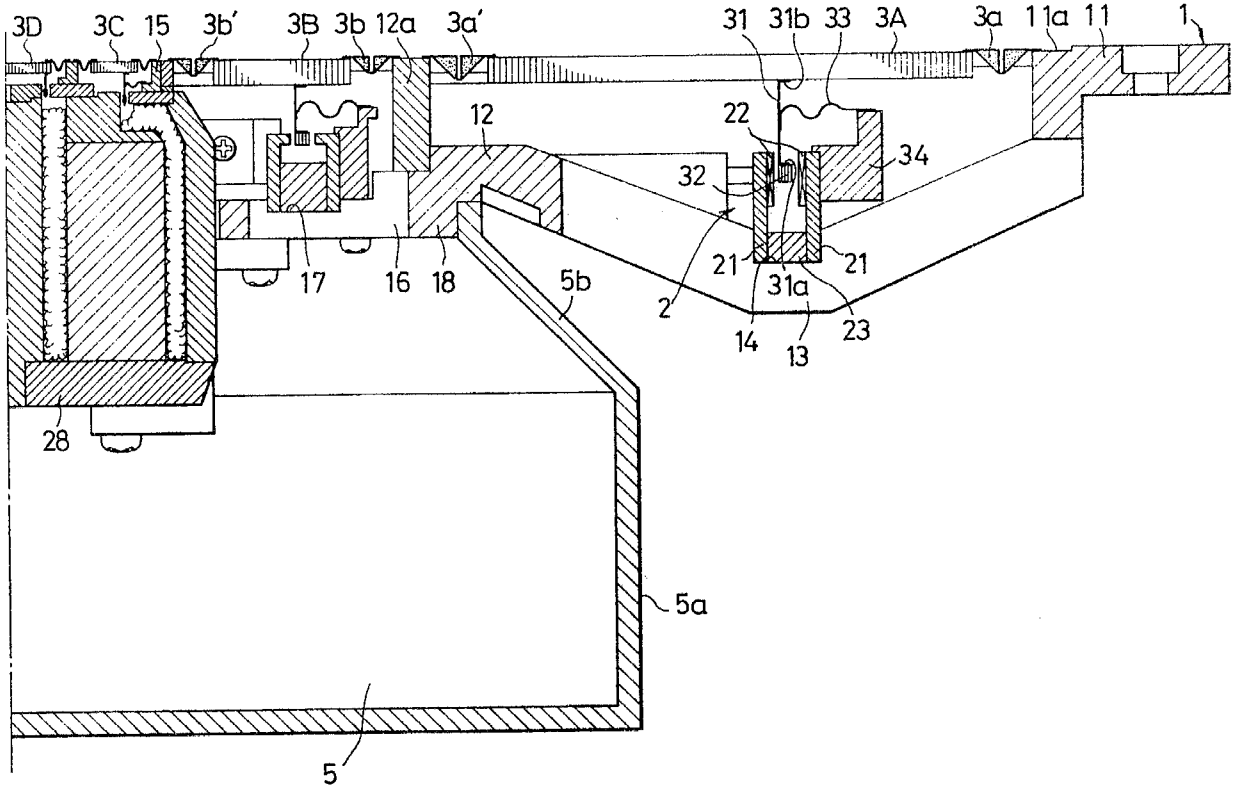
FIG. 2 is a cross-sectional view of the loudspeaker system shown in FIG. 1.

FIGS. 1 and 2 are, respectively, a schematic backside view of a coaxial 4-way planar diaphragm type loudspeaker system according to the invention and a cross-sectional view of the loudspeaker system shown in FIG. 1. In these Figures, reference numeral 3A designates a square-shaped bass-range planar diaphragm. In the center aperture of the square-shaped bass-range planar diaphragm 3A, a mid-range planar diaphragm 3B, a treble-range planar diaphragm 3C and a super-treble-range planar diaphragm 3D are coaxially arranged in the stated order. An outer periphery edge portion 3*a* of the bass-range planar diaphragm 3A is supported by a shoulder portion 11*a* of an outermost frame 11 whereas an inner pheriphery edge portion 3*a'* is supported by an edge supporter 12*a* which is attached to an inner circumferential frame 12 of a frame assembly 1 in such a manner that a front surface of the edge supporter 12*a* lies in the same plane as the front surface of the shoulder portion 11*a*. Provided centrally or radially is a center frame 15 which is connected to the inner circumferential frame 12 by eight connectors 16. In addition, the inner circumferential frame 12 is provided with a circular protrusion 18 to which a backchamber 5 is fittedly coupled. The outermost frame 11 and the inner circumferential frame 12 are rigidly connected by V-shaped bridges 13.

The backchamber 5 has a surface 5*b* inclined toward the inner circumferential frame 12 for the purpose of reducing the cross-sectional area with respect to the bass-range planar diaphragm 3A so that the side wall 5*a* of the backchamber 5 does not adversely affect the acoustic pressure caused by the reciprocating movement of the bass-range planar diaphragm 3A and further so that the backside opening area of the bass-range planar diaphragm 3A is not reduced by the provision of the backchamber 5 which is otherwise designed so as to have as large as possible an inner capacity which is as large as possible.

A magnetic circuit is made up of a pair of plates 21, magnets 22 and a yoke 23. The magnetic circuit constitutes a driver unit together with a voice coil bobbin 31, a voice coil 32, a damper 33 and a damper stand 34.

Figure 3:
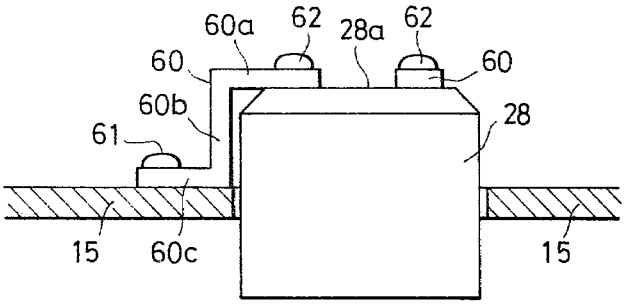
FIG. 3 is an explanatory diagram for a description of attaching a driving unit to a center flame.
Figure 4:
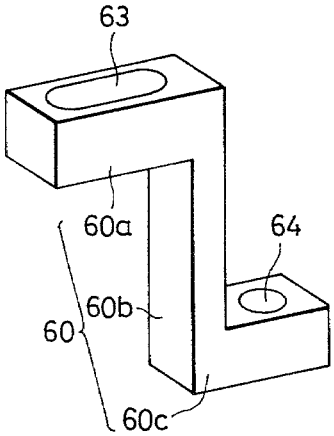
FIG. 4 is an enlarged perspective view illustrating an attachment member for attaching the driver unit to the center frame.

To construct a 3-way or 4-way planar diaphragm type loudspeaker system in which a treble-range and/or a super-treble-range loudspeaker unit are coaxially arranged other than with a mid-range loudspeaker unit, as is clear from FIG. 2, rear-side spaces corresponding to the treble-range diaphragm 3C and the super-treble-range diaphragm 3D are separated from one another by the center frame 15 and a driver unit 28 for the treble-range diaphragm. The cylindrical driver unit 28 is smaller than those for the bass-range and the mid-range and therefore the positioning thereof could be difficult during assembly. To eliminate such a difficulty, the driver unit 28 is not mounted directly on the center frame 15 but is mounted indirectly to the center frame 15 with the use of brackets 60 as shown in FIGS. 3 and 4. More specifically, the driver unit 28 is attached by four brackets 60 with each bracket 60 having a supporting portion adjacent to the bottom surface 28*a* of the driver unit 28, a main body portion 60*b* extending in the axial direction of the driver unit 28 and an attachment portion 60*c* bent perpendicularly to the main body portion 60*b*. The attachment portion 60*c* is provided with a cylindrical bore 64 through which a screw 61 extends and engages with a thread provided in the center frame 15 to thereby attach the driver unit 28 to the center frame 15. The supporting portion 60*a* is provided with an oblong bore 63 with a screw 62 extending therethrough and engaging with a thread provided in the bottom of the driver unit 28.

With the bracket 60 having the above described construction, since the bore 63 of the supporting portion 60*a* is oblong, it is possible to adjust the position of the driver unit 28 so that the center of the driver unit 28 coincides with that of the loudspeaker system. Accordingly, the driving mechanism for transmitting driving power to the voice coil of the treble-range diaphragm can be readily assembled and installed. While the above description is limited to the treble-range loudspeaker unit, the same mounting technique can be used for the driving unit of the super-treble-range loudspeaker unit.

With the backchamber 5, which has a constant depth thereof in order to enlarge the inner space mounted at the rear side of the mid-range planar diaphragm 3B, the side wall 5*a* of the backchamber 5 extends toward the rear-side space of the bass-range diaphragm 3A. According to the invention, since the side wall 5*a* is provided with an inclined portion 5*b* so that the cross-sectional area of the backchamber 5 decreases towards the inner circumferential frame 12, there is no interference with the reciprocating movement of the bass-range diaphragm 3A. Furthermore, the backchamber 5, which is used for individually separating the rear-side spaces of the mid-range and the treble-range planar diaphragms, is rigidly mounted to the inner circumferential frame 12. Hence, the thus assembled multi-way planar diaphram type loudspeaker system can be readily mounted in a conventional style baffle board in the same manner as a conventional multi-way loudspeaker system using cone-shaped diaphragms.

As is apparent from the above description, in the loudspeaker system according to the invention, the planar diaphragms are coaxially arranged and supported by a common frame, at least the inner peripheral edge portion of the bass-range diaphragm and the outer peripheral edge portion of the mid-range diaphragm are supported by a common edge stand, the rear-side spaces corresponding to the planar diaphragms are separated so that the acoustic pressures caused by each diaphragm do not cause interference with the other diaphragms, and the backchamber is designed so as not to interfere with the reciprocating movement of the bass-range diaphragm and is capable of being readily mounted on the inner circumferential frame. As a result, the thus assembled coaxial multi-way planar diaphragm type loudspeaker system is simple in construction, economical, readily assembled and has excellent acoustic characteristics. Furthermore, it should be noted that the loudspeaker system of the invention can be mounted in a conventional speaker cabinet without modification of the baffle board of the cabinet.

What is claimed is:

1. A coaxial planar diaphragm loudspeaker system comprising at least a bass-range substantially square planar diaphragm and a mid-range substantially square planar diaphragm, said mid-range planar diaphragm being coaxially arranged with respect to said bass-range planar diaphragm so that said diaphragms are also coplanar, an outer rigid frame assembly, an inner circumferential frame rigidly coupled to said outer frame assembly, a sealed backchamber fittedly secured to said inner circumferential frame, a common edge stand rigidly secured to said inner circumferential frame opposite to said backchamber, an inner peripheral edge portion of said bass-range diaphragm and an outer peripheral edge portion of said mid-range diaphragm being commonly supported by said edge stand, and individual electromagnetic diaphragm-driving units mounted on said outer frame assembly and said inner circumferential frame for driving said bass-range and mid-range diaphragms, respectively.

2. The loudspeaker system of claim 1 further comprising a plurality of V-shaped bridge members for rigidly coupling said inner circumferential frame to said outer frame assembly.

3. The loudspeaker system of claims 1 or 2 wherein said common edge stand serves as a blocking wall for dividing the rear-side space of said bass-range diaphragm from the rear-side space of said mid-range diaphragm.

4. The loudspeaker system of claim 1 or 2 wherein said backchamber has a substantially planar rear wall extending perpendicular to the longitudinal axis of said speaker system, a cylindrical portion coupled to said rear wall and extending forwardly towards said inner circumferential frame, and a slanted wall portion extending between said cylindrical portion and said inner circumferential frame, the cross-sectional area of said backchamber decreasing from the juncture between said cylindrical portion and said slanted wall portion towards said inner circumferential frame.

5. The loudspeaker system of claim 4 wherein said common edge stand serves as a blocking wall for dividing the rear-side space of said bass-range diaphragm from the rear-side space of said mid-range diaphragm.

6. A multi-range planar diaphragm electromagnetic loudspeaker system having at least three substantially square planar diaphragms, the number of which is equal to the number of ranges, wherein the improvement comprises:

a first generally rectangular frame member;

a bass-range substantially square planar diaphragm having a center opening and being supported at its outer peripheral edges by the inner peripheral edges of said first frame member;

a second inner frame member fixed to said first frame member;

a substantially square planar mid-range diaphragm having an opening therein and disposed within the opening of said bass-range diaphragm and coaxial therewith so that said diaphragms are also co-planar, the inner edges of said bass-range diaphragm and the outer edges of said mid-range diaphragm being commonly supported by said second inner frame member;

a sealed backchamber fixed to said second inner frame member and disposed substantially out of the back pressure space of said bass-range diaphragm;

a third center frame member secured to said second frame member;

a high-range substantially square planar diaphragm disposed within the opening of said mid-range diaphragm and disposed coaxially therewith, said high range diaphragm being supported at its outer edges by said third frame member, said third member forming a barrier between the back pressure spaces of said mid-range and high-range diaphragms; and individual electromagnetic diaphragm-driving units mounted on said first, second and third frame members for driving said bass-range, mid-range and high-range diaphragms, respectively.

7. The improvement of claim 6:

wherein said high-range diaphragm has a substantially rectangular opening therein; and further comprising:

a substantially square treble-range planar diaphragm disposed within the opening of said high-range diaphragm and disposed coaxially therewith so that said bass-range, mid-range, high-range and treble-range diaphragms are co-planar and co-axial;

support means secured to said third center frame for commonly supporting the inner edges of said mid-range diaphragm and the outer edges of said high-range diaphragm;

means mounted on said center frame member for commonly supporting the outer edges of said treble-range diaphragm and the inner edges of said high-range diaphragm, and for forming a barrier between the back spaces of said high-range and treble-range diaphragms; and an electromagnetic driving unit mounted on said third frame member for driving said treble-range diaphragm.

8. The improvement of claim 7 wherein said backchamber encloses the back sides of said mid-range, high-range and treble-range diaphragms, and wherein the back wall of said backchamber is parallel to the co-planar diaphragms and extends into the back space of said bass-range diaphragm only at a distance remote from said bass-range diaphragm, the front wall portion of said backchamber being slanted away from the near back space of said bass-range diaphragm and towards said mid-range diaphragm so that said backchamber does not interfere with the variations in acoustical pressure on the back side of said bass-range diaphragm.

* * * * *